United States Patent [19]
Bethune et al.
[11] 4,342,389
[45] Aug. 3, 1982

[54] CONTAINER WITH INTEGRAL HANGER BAR

[75] Inventors: Billy R. Bethune; Charles C. Dearing, both of Chattanooga, Tenn.

[73] Assignee: Container Corporation of America, Chicago, Ill.

[21] Appl. No.: 235,908

[22] Filed: Feb. 19, 1981

[51] Int. Cl.³ ..... B65D 85/18
[52] U.S. Cl. ..... 206/288; 206/290
[58] Field of Search ..... 206/288, 289, 290, 299, 206/300, 284, 285, 279, 291, 292; 229/34 HW

[56] References Cited

U.S. PATENT DOCUMENTS 3,565,242 2/1971 Konkoli ..... 206/290
4,060,169 11/1977 Hildebrand et al. ..... 206/289
4,085,842 4/1978 Beck ..... 206/289
4,089,411 5/1978 Gardner ..... 206/300
4,098,399 7/1978 Bethune ..... 206/288
4,111,300 9/1978 Partain ..... 206/280
4,119,197 10/1978 Pilz ..... 206/279

*Primary Examiner*—William Price
*Attorney, Agent, or Firm*—R. W. Carpenter; Davis Chin

[57] ABSTRACT

The invention structure comprehends the provision of a hanger bar formed from flaps extending from the ends of side walls of the container body, the flaps being retained in position between an end wall of the container body and inner locking walls. Portions of the flaps are folded into position to define the hanger bar which extends into the container body.

8 Claims, 7 Drawing Figures

CONTAINER WITH INTEGRAL HANGER BAR

BACKGROUND OF THE INVENTION

1. Field of the Invention

The invention relates to shipping containers of the kind for supporting hangers for apparel.

2. Description of the Prior Art

The prior art appears to be best exemplified in the following patents which were developed in a search directed to the subject matter of this application: U.S. Pat. Nos. 4,060,169; 4,085,842; 4,089,411; 4,098,399; 4,111,300 and 4,119,197.

In the structures of the prior art, none of them provide a hanger bar for the hangers supporting the apparel, wherein the hanger bar is formed integrally with the elements forming the container for the apparel.

SUMMARY OF THE INVENTION

The invention structure comprehends the provision of a hanger bar formed from flaps extending from the ends of side walls of the container body, the flaps being retained in position between an end wall of the container body and inner locking walls. Portions of the flaps are folded into position to define the hanger bar which extends into the container body.

DESCRIPTION OF THE PREFERRED EMBODIMENT

Figure 1:
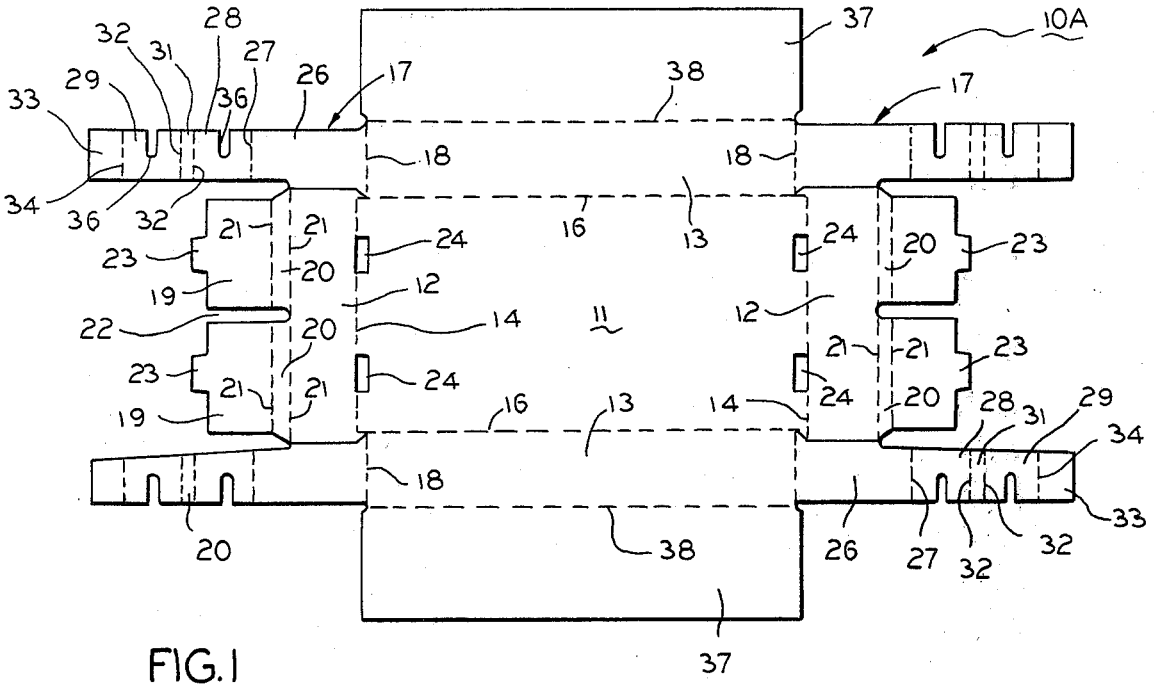
FIG. 1 is a plan view of a cut and scored blank for forming a container, according to the present invention.
Figure 2:
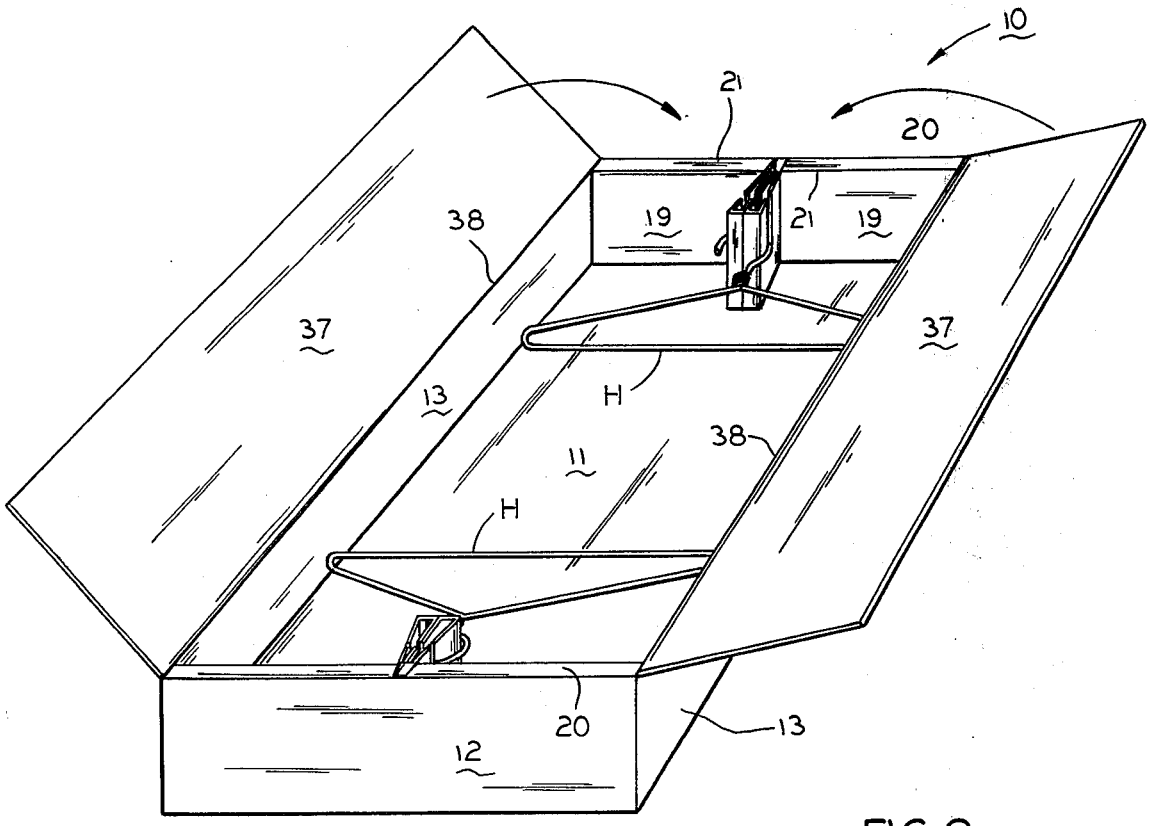
FIG. 2 is a perspective view of a container formed from the blank of FIG. 1.

Referring now in detail to the drawings, the container having an integral hanger bar is denoted by reference numeral 10 (FIG. 2) and is constructed from a cut and scored blank 10A (FIG. 1). It is adapted to support therein one or more hooked hangers H, the hooks thereof being engaged with the hanger bars of container 10.

Blank 10A for forming container 10 comprises a bottom panel 11 with opposed end walls 12 foldable with respect thereto along fold lines 14, and opposed side walls 13 foldable with respect thereto along fold lines 16. Walls 12 and 13 are erected with respect to bottom panel to define a tray.

Flaps 17 extend from each end of side walls 13 and are foldable with respect thereto along fold lines 18. A pair of inner locking walls 19 are foldable with respect to end wall 12 along closely spaced score lines 21 which define therebetween a narrow end rim 20. The proximate ends of locking walls 19 are spaced from each other to define a slot 22 therebetween. Locking walls 19 are each provided with Walker tabs 23 engageable with Walker slots 24 in bottom panel 11.

Figure 3:
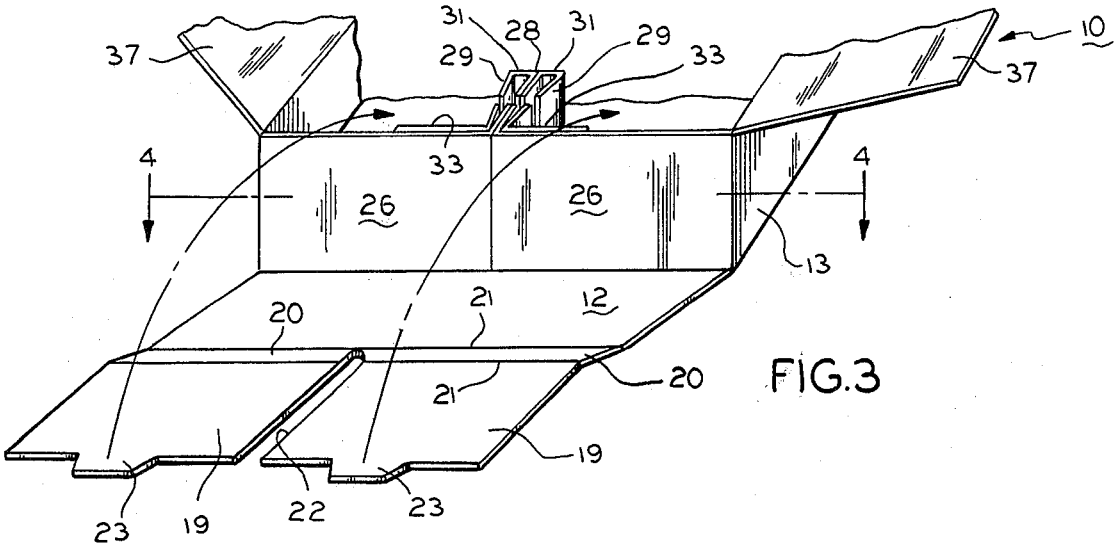
FIG. 3 is a perspective view of a portion of the container of FIG. 2, showing the manner in which a hanger bar therein is formed.
Figure 4:
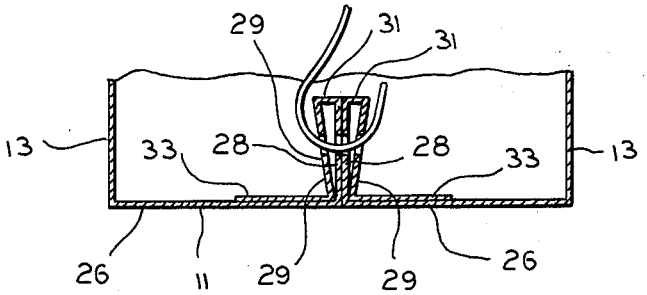
FIG. 4 is a horizontal, cross-sectional view taken through the hanger bar along the lines 4—4 of FIG. 3.

Each flap 17 has a flap portion 26 foldable into position along the inside of wall 12 along fold line 27, and distal portions 28, 29, 31 and 33 are foldably connected to flap portion 26 and to each other along fold lines 27, 32 and 34. As seen particularly in FIGS. 3 and 4, each flap 17 has the distal portions thereof folded to define a structure of essentially triangular shape in horizontal cross-section. The two structures define in horizontal cross-section a trapezoidal structure with its larger base spaced from end wall 12. Slots 36 in portions 28 and 29 fall into register to receive the hook of hanger H.

The structures formed by folding of portions 28, 29, 31 and 33 are held in place, extending over main panel 11, by the inner locking walls 19 which are locked in position at the Walker slot 24. The end portion 33 of distal portions of flap 17 is captured between locking wall 19 and end wall 12. In the locking step the two triangular structures can be displaced sufficiently to permit locking of the walls 19 into position.

The tray thus far described is provided with closure flaps 37 foldable with respect to side walls 13 along fold lines 38, the folded over flaps 37 resting upon the hanger bars described.

Figure 7:
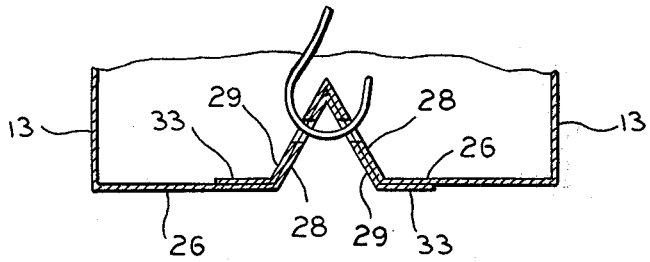
FIGS. 5, 6 and 7 are horizontal, cross-sectional views taken through other forms of hanger bars.
Figure 5:
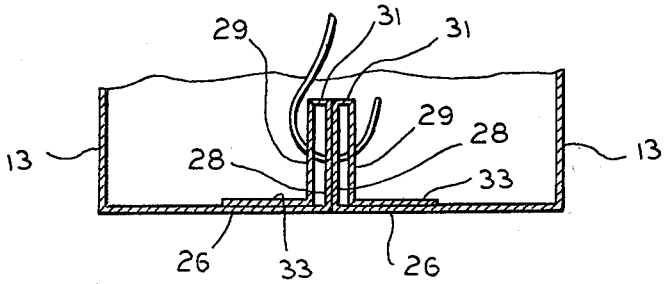
Figure 6:
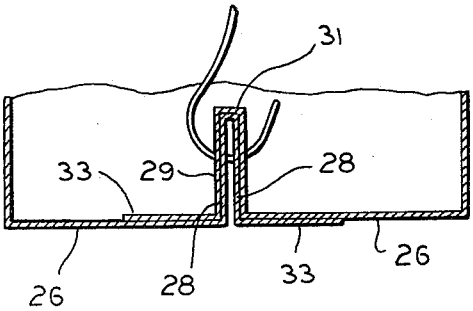

In FIGS. 5 to 7, there are shown variations in the forming of the hanger bars. In FIG. 5, the hanger bar is formed of two side by side portions, each of rectangular cross-section. Reference numerals thereof correspond to the numbers employed in describing FIGS. 1 through 4.

In FIG. 6, the hanger bar is formed of portions of rectangular cross-section, one of which is enclosed within the other. In FIG. 7, the hanger bar is of triangular cross-section, one portion being enclosed within the other. In this embodiment the locking walls 19 have a larger slot 22 therebetween. In all views (FIGS. 4 to 7), the hook of hanger H is shown in position of engagement with a hanger bar.

What is claimed is:

1. In a container for shipping articles such as hanger supported garments, said container being formed from a blank of paperboard or the like and comprising:

(a) a bottom panel having opposed end and side walls foldably connected to said bottom panel to define a tray;

(b) flaps extending from ends of said side walls and having portions extending along the inner face of an end wall;

(c) a pair of inner locking walls foldable with respect to an end wall and foldable into locking position with said bottom panel with said portions of said flaps embraced therebetween, the proximate ends of said locking walls being spaced from each other to define a slot; and (d) distal portions of said flaps extending through said slot and being folded to position to define a hanger bar for garments.

2. A container according to claim 1, wherein said distal portions are provided with slots falling into register upon folding of said distal portions to position to provide for placement of a hanger hook thereat.

3. A container according to claim 1, wherein each of said flaps has an end portion thereof receivable between a locking flap and the end wall.

4. A container according to claim 1, wherein closure flaps are hingedly connected to said side walls and are foldable into position over said hanger bar.

5. A container according to claim 1, wherein said hanger bar is formed by folding of the distal portions of said flaps, and said inner locking walls are folded to individual locking position.

6. A container according to claim 1, wherein said hanger bar comprises a plurality of plies of paperboard.

7. A container according to claim 6, wherein said hanger bar is triangular in horizontal cross-section.

8. A container according to claim 6, wherein said hanger bar is rectangular in horizontal cross-section.

* * * * *